US006244657B1

(12) United States Patent
Momose

(10) Patent No.: US 6,244,657 B1
(45) Date of Patent: Jun. 12, 2001

(54) SEAT ERECTING/FOLDING STRUCTURE FOR MOVABLE SPECTATORS' STAND

(75) Inventor: Michiyoshi Momose, Tokyo (JP)

(73) Assignee: Kabushikikaisya Kotobuki, Tokyo (JP)

( * ) Notice: Subject to any disclaimer, the term of this patent is extended or adjusted under 35 U.S.C. 154(b) by 0 days.

(21) Appl. No.: 09/380,960

(22) PCT Filed: Jul. 3, 1998

(86) PCT No.: PCT/JP98/03007

§ 371 Date: Oct. 27, 1999

§ 102(e) Date: Oct. 27, 1999

(87) PCT Pub. No.: WO99/36645

PCT Pub. Date: Jul. 22, 1999

(30) Foreign Application Priority Data

Jan. 14, 1998 (JP) ..... 10-005699

(51) Int. Cl.[7] ..... A47C 31/00

(52) U.S. Cl. ..... 297/217.7; 52/9; 297/331; 297/335

(58) Field of Search ..... 297/15, 331, 335, 297/217.7; 52/9, 10, 8

(56) References Cited

U.S. PATENT DOCUMENTS 4,211,450 * 7/1980 Sutter ..... 52/9 X
4,569,162 * 2/1986 Suzuki ..... 52/9
4,702,043 * 10/1987 Suzuki ..... 52/9
5,653,502 * 8/1997 Kimura et al. ..... 297/335 X
5,685,608 * 11/1997 Yamazaki ..... 52/9 X
5,819,475 * 10/1998 Momose ..... 297/331 X

FOREIGN PATENT DOCUMENTS 62-201109 9/1987 (JP) .
1-142753 9/1989 (JP) .
1-158753 11/1989 (JP) .

* cited by examiner

*Primary Examiner*—Peter M. Cuomo
*Assistant Examiner*—Stephen Vu
(74) *Attorney, Agent, or Firm*—Young & Thompson

(57) ABSTRACT

A chair-raising and folding construction is simple in construction and reduced in weight, and is also capable of, when using a moving stand with lower stages of decks protracted, effectively preventing spectators, etc. from entering into non-used decks protracted. The moving stand telescopically accommodates and protracts a plurality stages of decks (1,2). Each of the decks (1,2) has a plurality of raisable and foldable chairs (3). A leg portion (5) of the chair (3) is hinge-connected to a base frame (4) disposed on the deck (1). A crank member (10), comprising a swing arm (12) protruding upward from the base frame (4), and a hook (13) protruding forward from a lower end portion of the swing arm (12), is rotatably supported at a corner portion thereof. The swing arm 12 has such a protruding length such that a distal end portion thereof abuts against a front end surface (2*a*) of the upper stage-side deck (2). The leg portion (5) is provided with a lock member (9) engaged with the hook when the leg portion takes the raised attitude.

8 Claims, 15 Drawing Sheets

SEAT ERECTING/FOLDING STRUCTURE FOR MOVABLE SPECTATORS' STAND

TECHNICAL FIELD

The present invention relates to chair-raising and folding constructions for moving stands which are applied to not only indoor facilities such as gymnasiums, lecture halls, and multi-purpose halls, but also indoor or outdoor athletic facilities, and public halls, etc. This moving stand is substantially of a telescopic construction as a whole and so constructed such that a plurality of stages of decks are protracted step-wise on occasion demands, and the decks can be, after use, accommodated while being arranged in an up-and-down directions. In this chair-raising and folding constructions, only folding operation of a plurality of chairs, which are arranged continuously to one another or independently on each of the decks, is automated.

BACKGROUND ART

Conventionally, various kinds of moving stands, which can telescopically accommodate and protract a plurality of stages of decks horizontally arranged, have been proposed. They are, in most cases, capable of providing a plurality of chairs on each of the decks, thereby enabling a predetermined number of spectators, etc. to sit on the moving stand.

Then, in such a moving stand, accommodating the respective decks when they are unused requires causing each of the chairs to take the folded attitude forward, which requires causing each of the chairs to take the raised attitude, enabling the spectators to sit thereon, when the moving stand is used.

Therefore, as described in JP-A-62-201109, the applicant has proposed an automatic chair-raising and folding apparatus which is capable of automatically raising and folding chairs without using special power sources, with the protracting and accommodating operation of decks.

In this apparatus, a main part of which is shown in a side view of FIG. 1, a bed frame 103 is disposed on a deck 101, and a chair leg 105 is arranged on the bed frame 103 raisably and foldably. A three-pronged lock ring 111 has a locking and unlocking roller 107 as a weight, and a hook portion 109 at a lower pronged portion thereof. The leg 105 is connected with the three-pronged lock ring 111 with a front end penetrating shaft 113 as a fulcrum in such a manner that the roller 107 can move downward. Disposed on a back side of the leg 105 is a locking angle 115 for holding the leg 105 in the raised state due to the engagement with the hook portion 109 of the lock ring 111 with the roller 107 moving downward; therefore, when the deck 101 is retreated, the roller 107 abuts against the upper stage-side deck 117, thereby causing the hook portion 109 and the locking angle 115 to be released and disengaged from each other. As a result, protracting each of the decks causes the chairs to be automatically raised, and accommodating each of the decks causes the chairs to be automatically folded forward.

The proposed technique has, however, disadvantages that the construction of the apparatus becomes complicated, and further the weight of the apparatus, in its turn the weight of each stage of the decks is increased.

Also, when the moving stage is used with only intermediate stages of the decks, i.e. the lowest two stages of the decks out of six stages of the decks protracted, suitably seating on the chairs of the second deck, i.e. raising up backrests of the chairs, disposed on the second deck, above a passage B of the third deck A requires causing the third deck A also to take the protracted attitude. According to the proposed technique, protracting the third deck A causes the chairs disposed on the deck to necessarily take the raised attitude; therefore, there is a disadvantage, from the viewpoint of spectator-guide-countermeasure, that the spectators, etc. are required to be prevented from entering into the passage B by taking a suitable countermeasure of surely preventing the spectators from using the chairs C, e.g. roping off, or fencing in the place, or guiding the spectators, etc. by guides, guards, etc.

Moreover, in such a case, when the chairs C on the third deck A are free to be used, the backrests of the chairs C interfere with the upper stage-side accommodating deck above the deck A, thereby disabling the backrests to be sufficiently folded rearward, which disables the seat to take a satisfactory free attitude. Therefore, not only the comparability to sit on becomes bad, but also unexpected forces act on the chairs C, which possibly may cause the chairs C to get out of order, etc.

Also, in the proposed technique, automatic raising and reversing apparatuses are independently arranged for respective chairs on the same deck. For example, as exemplified in FIG. 3, so long as the first stage deck D retreats during the protracted decks are accommodated while being inclined in the fore and rear direction, i.e. in the advancing and retreating direction, under the influence of the condition, such as unevenness of the floor on which the moving stand is disposed, and so on, even when the chairs disposed on one end portion of the deck D in the longitudinal direction, in its turn the leg 105 of the chair is unlocked, and hence the leg 105 starts to fold, the legs 105 of the other chairs may be still in the locked condition. Especially when a plurality of chairs disposed on the deck D are so-called connected chairs which are connected to one another, the occurrence of the above-mentioned state provides a problem that the connected chairs undergo an unexpected large torsional external force, etc. not only thereby causing the connected chairs to be damaged worst of all, but also thereby causing the deck D to be retreated to disable the other chairs to be smoothly unlocked. The same is true of the advancing and retreating direction-wise inclination of the deck when the specified deck is advanced to thereby be protracted.

The present invention has been made as a result of investigating the subject of solving the above-mentioned problem included in the above proposed technique. It is therefore an object of the present invention to provide a chair-raising and folding construction for a moving stand, which is capable of precluding the possibility of increasing the weight of decks, and effectively preventing spectators, etc. for entering into a surplus stage of decks which are, when lower decks are protracted for use, obliged to be protracted to a rear side of the lower decks, and to provide a chair-raising and folding construction for a moving stand, which is capable of, even if a plurality of chairs disposed on the deck are connected to one another, not only raising but also folding smoothly and surely the connected chairs irrespective of the retracted attitude of the deck, and also of satisfactorily preventing the connected charts from receiving a torsional force, etc.

DISCLOSURE OF THE INVENTION

The present invention provides a chair-raising and folding construction for a moving stand, which is capable of substantially telescopically accommodating and protracting a plurality stages of horizontal decks arranged at spaces in up-and-down directions, each of the decks having a plurality of chairs thereon raisably and foldably, wherein a leg portion of the chair is hinge-connected foldably forward to a base frame disposed on the deck, a crank member, comprising a swing arm protruding upward from the base frame, and a hook protruding forward from a lower end portion of the swing arm, is rotatably supported on a rear portion of the leg portion at a corner portion thereof, the swing arm has such a protruding length as that a distal end portion thereof abuts against a front end surface of the upper stage-side deck, and the leg portion is provided with a lock member engaged with the hook when the leg portion takes the raised attitude.

According to this raising and folding construction, the construction as a whole becomes simple, and the total weight is reduced. Also, in this construction, when a desired number of stages of decks are retracted, the connected chairs or the respective independent chairs disposed on each of the decks, which takes the folded attitude, are raised by the workers, thereby causing the lock member disposed on the leg portion of the chair to be engaged to the hook disposed on the crank member, which enables the chair to surely take the raised attitude.

On the other hand, the chair taking the raised attitude is folded by causing the front end surface of the upper stage-side deck to abut, when retracting or accommodating the decks, against the swing arm of the crank member disposed on the deck to thereby swing the swing arm forward, which enables the hook and the lock member of the leg portion to be disengaged from each other. This enables the chairs to be automatically folded with the accommodation of the decks.

According to such a raising and folding construction, when using the lower decks, in its turn the chairs disposed on the decks, as is the case with those above mentioned, the chairs disposed on a surplus stage of the decks which is obliged to be protracted can be maintained in the folded state, thereby not only preventing the spectators, etc. from sitting on the chairs disposed on the surplus stage of the decks, but also effectively preventing the spectators, etc. from unexpectedly entering into the surplus state of the decks without disposing special entering-restricting means, stationing guides, etc.

In such a chair-raising and folding construction, more specifically, shafts of rotatably supporting the crank members to the base frames are constructed as a common shaft of all the crank members arranged on the same deck. This enables the action of one of the crank members, in its turn its swing arm to be transmitted to all the crank members.

As a result, so long as the hook and the lock member of the leg portion are, when the swing arm and the front end surface of the upper stage-side deck are abutted against each other, disengaged from each other in one of the crank member even if one stage or plural stages of the decks are, especially when the decks are accommodated, retreated while being inclined in the protracting and retracting direction, the action of the common shaft causes all the crank members disposed on the same deck to be unlocked, thereby causing all the chairs to start to smoothly fold. This, even if the chairs disposed on the deck are connected to one another, prevents the connected chairs from receiving an unexpected external force, such as a torsional external force, thereby enabling the chairs to be smoothly and surely folded without the possibility of damaging the chairs, etc.

Still preferably, this chair-raising and folding construction further comprises leg portion spring means for urging the leg portion of the chair in the raising direction, and a stopper for preventing the leg portion from being inclined rearward.

This leg portion spring means functions to assist the manual raising operation of the chairs. Also, the stopper functions to prevent, when the chairs are locked in the raised condition, the chairs from being displaced more rearward to stabilize its raised attitude.

Further preferably, there are provided auxiliary spring means, such as an extension spring, a compression spring, a torsion spring, etc., for urging the swing arm rearward, and positioning means for restricting the rearward inclined position of the swing arm. Accordingly, each of the auxiliary means and the positioning member is capable of returning the crank member in such arm-raised attitude as that the swing arm abuts against the positioning member, and further of automatically and surely locking the chair to the raised position without the manual work under the action of the auxiliary spring means.

Still preferably, the leg portion of the chair and the crank member are connected to each other by a link member, such as a pressing or tensile link member, forcing the swing arm to be folded forward with the folded movement of the leg portion, and the construction comprises auxiliary spring means, such as an extension spring, a compression spring, a torsion spring, etc., for urging the swing arm rearward.

Accordingly, the action of the auxiliary spring means for urging the swing arm rearward causes the lock member of the leg portion and the hook of the crank member to be surely engaged to each other when the leg portion is raised. On the other hand, abutment between the distal end of the swing arm and the front end surface of the upper stage-side deck causes the above-mentioned engagement to be released, thereby enabling the leg portion, in its turn the chair to be folded forward, as is the case with those above mentioned.

Then, on this occasion, when the chair is thus folded, the link member functions to cause the arm to be folded forward against the spring force of the auxiliary means, and then the swing arm is maintained in the folded state even when it is accommodated below the upper stage-side deck, which eliminates the need for arm guide means arranged on the back surface of the upper stage-side deck at a plurality of locations in the longitudinal direction of the deck, or the lateral direction of the stand, for preventing the distal end of the swing arm from abutting against the main body of the upper stage-side deck when the upper side deck is contacted to the distal end of the swing arm to be advanced, as is the case in which the swing arm is maintained in the raised attitude even when the leg portion is in the folded state. This reduces the weight and the cost of the deck, and further eliminates the need for the design man-hours required to determine the arrangement of the arm guide means, etc.

Further preferably, there are provided one kind of so-called over center type spring means, such as a pressing or tensile spring, for urging the swing arm in a forward and a rearward direction with the folding-displacement and the raising-displacement of the leg portion, respectively, and positioning means for restricting the rearward inclined position of the swing arm.

Accordingly, when the leg portion is folded or raised, the action of the over center type spring means causes the swing arm to undergo a click movement, thereby enabling the swing arm to be, as is the case with those above mentioned, maintained in the folded attitude forward during the time the leg portion is folded, which provides the same effect as those above mentioned. Furthermore, there is no need for providing the auxiliary spring means for urging the swing arm rearward.

BEST MODE FOR CARRYING OUT THE INVENTION

Figure 1A:
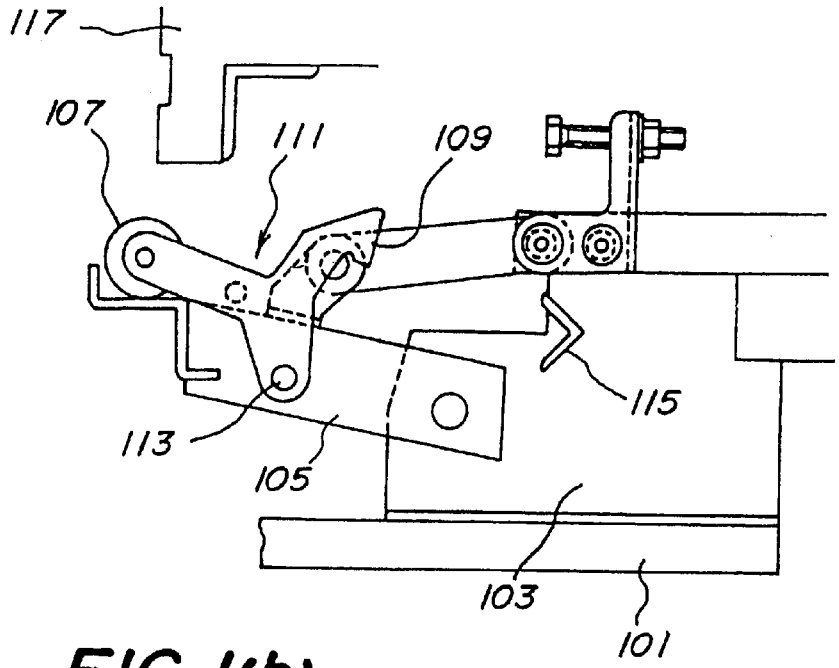
FIG 1(a) PRIOR ART
FIGS. 1 are side views of a main portion of a prior art.
Figure 1B:
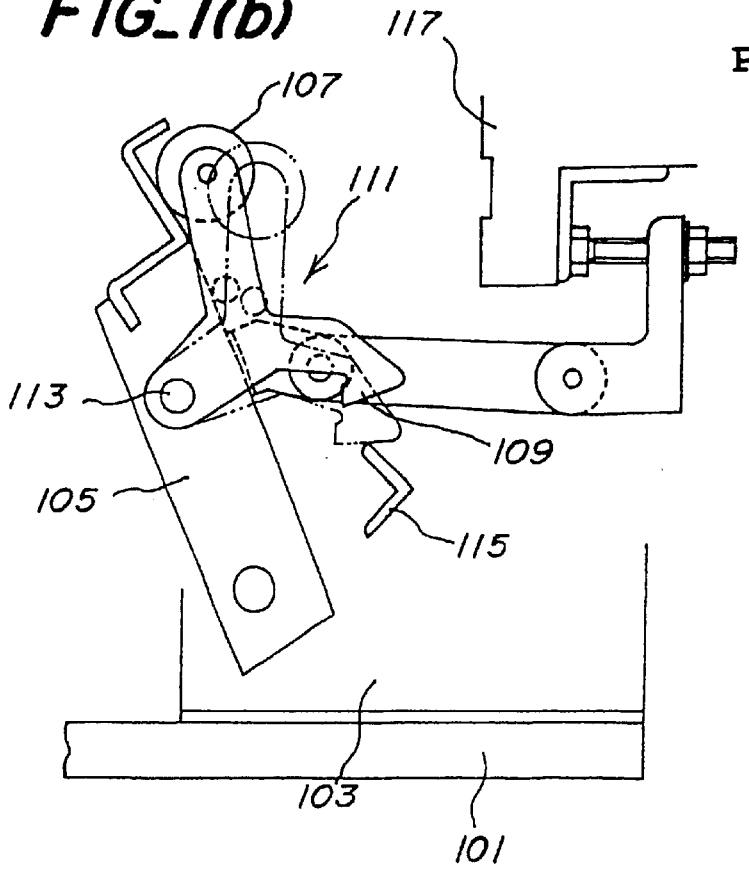
FIG 1(b) PRIOR ART
Figure 2:
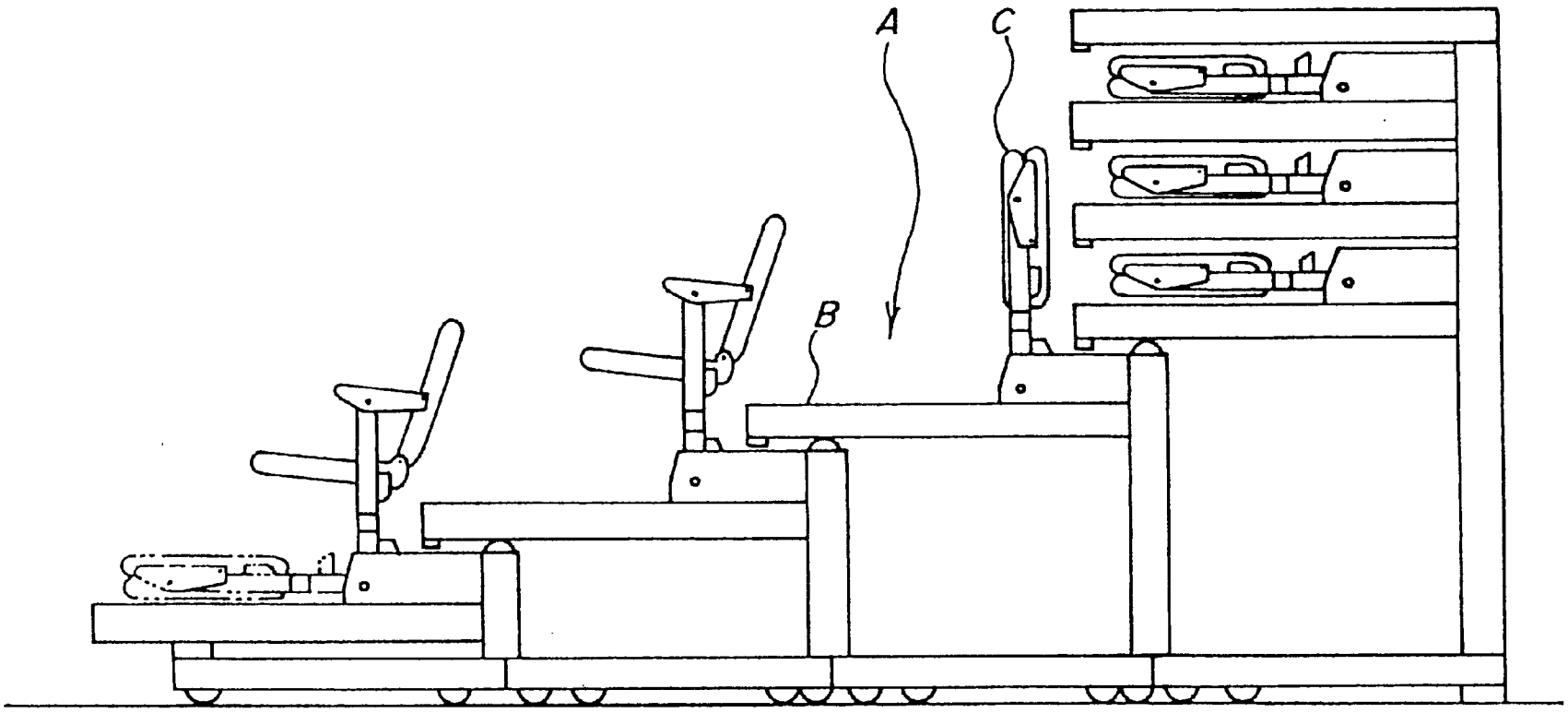
FIG. 2 PRIOR ART
FIG. 2 is a side view showing a state in which lower stages of decks are protracted.
Figure 3:
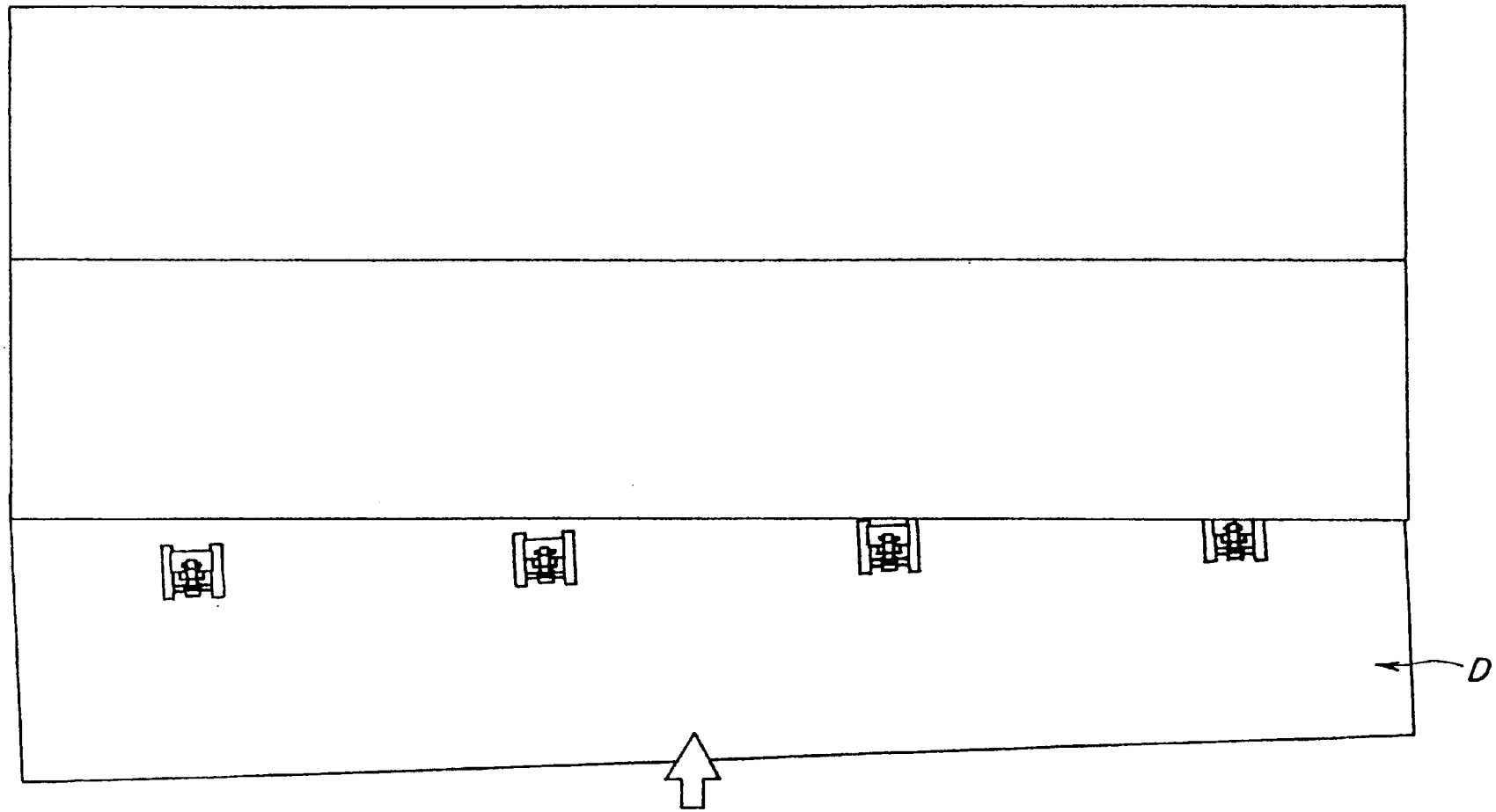
FIG. 3 PRIOR ART
FIG. 3 is a schematic plan view showing a state in which a deck is retracted in an inclined condition.
Figure 4:
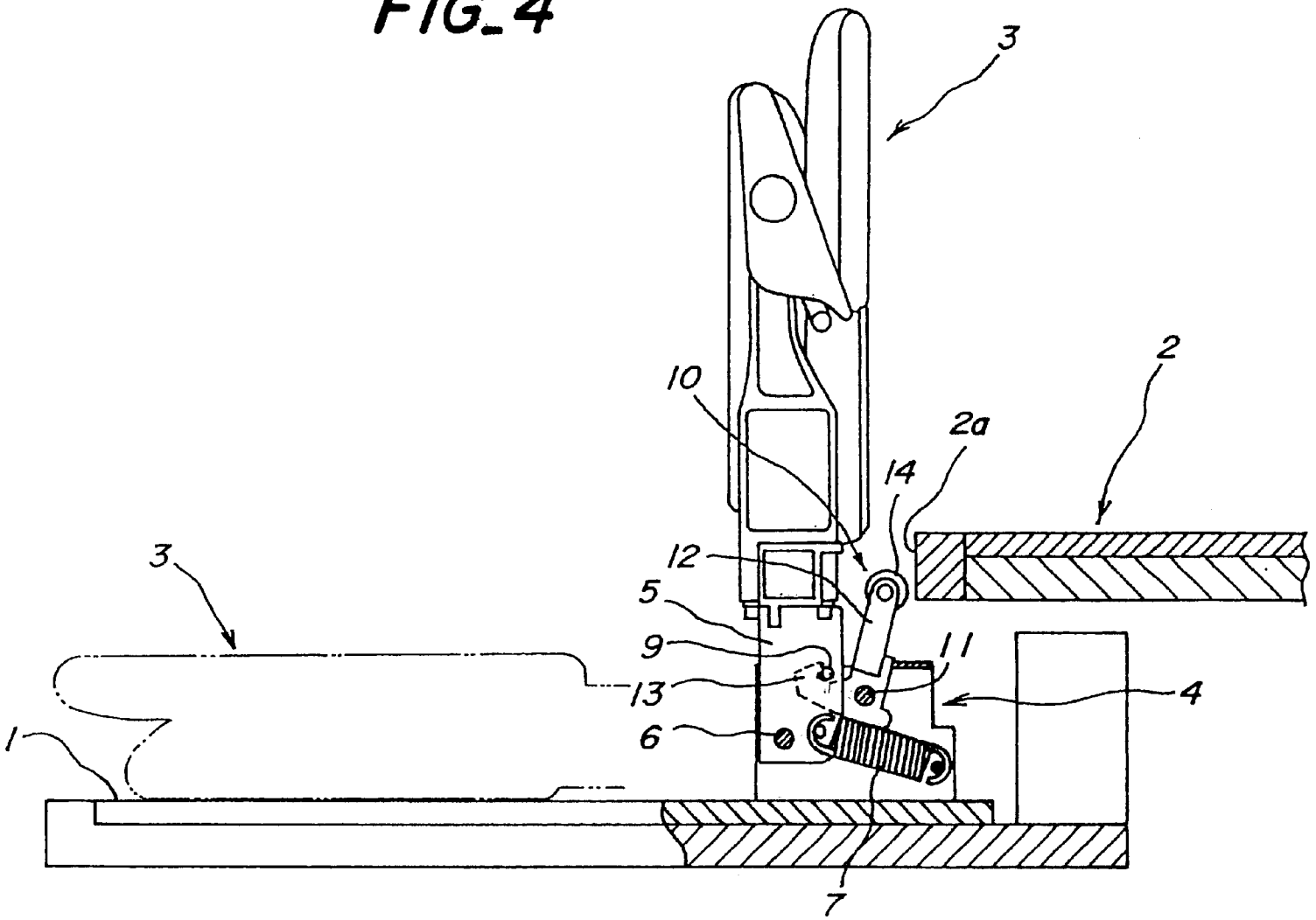
FIG. 4 is a partially sectional side view of an embodiment of the present invention.

FIG. 4 is a partially sectional side view showing an embodiment of the present invention in association with a specified deck. In FIG. 4, reference numeral 1 designates a lower stage-side deck arranged in the horizontal attitude, and 2 an upper side deck arranged in the horizontal attitude also, while the decks 1 and 2 taking the protracted attitude.

Frames 4 are arranged on a rear end portion of each of the decks, i.e. the lower stage-side deck 1 in FIG. 4 so as to be positioned corresponding to chairs 3, respectively, and leg portions 5 of the chairs 3 is hinge-connected to the base frames 4, respectively, thereby enabling the leg portions 5, in its turn the chairs 3 to be rotated between the raised position shown by the actual line in FIG. 4 and the forward folded position shown by the imaginary line in FIG. 4.

Figure 5A:
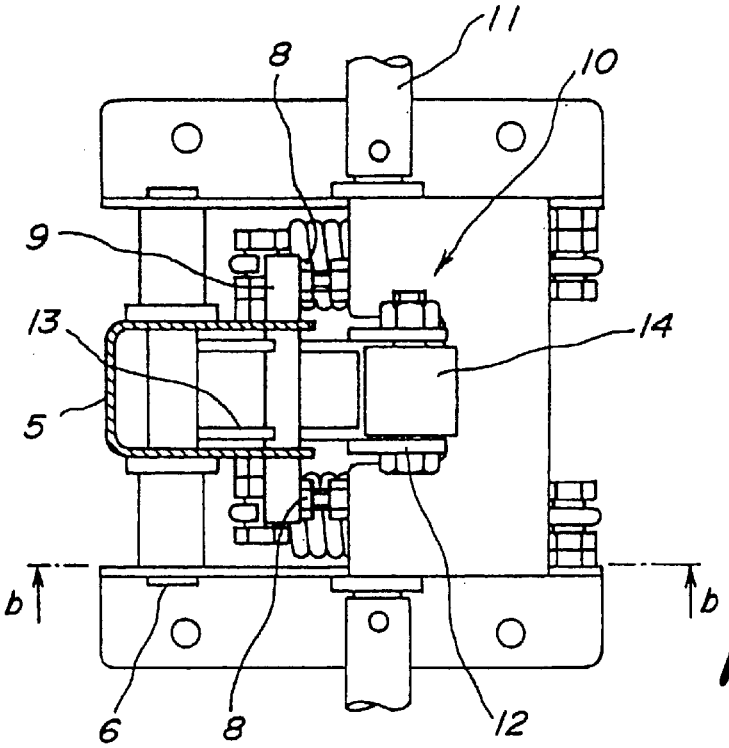
FIGS. 5 are enlarged views of a main part of the embodiment shown in FIG. 4.
Figure 5C:
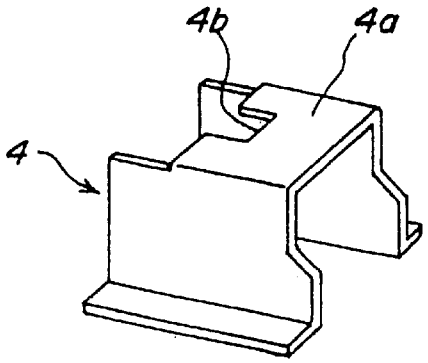
Figure 5B:
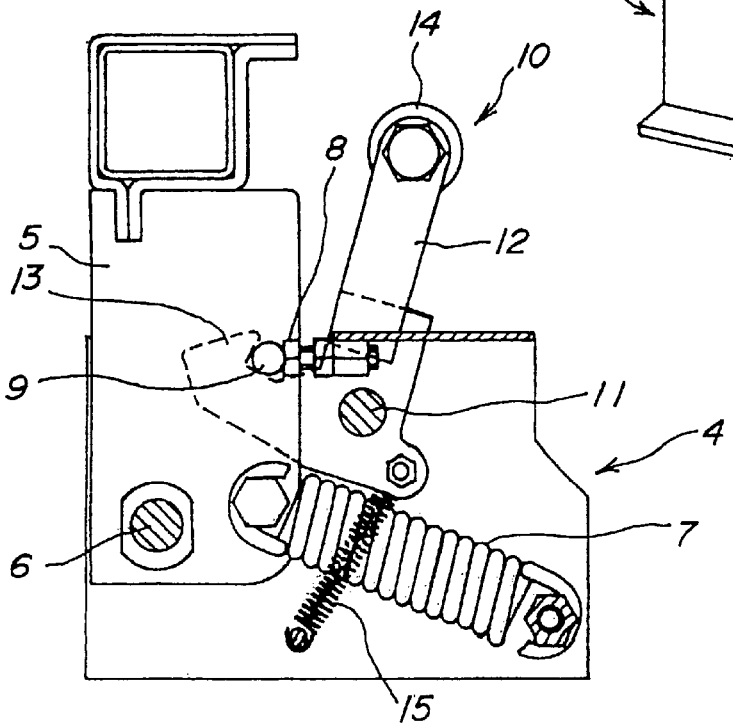

Preferably, leg portion spring means, e.g. a coil spring 7 for urging the leg portion 5 in the raised direction is connected to the leg portion 5 and the base frame 4, respectively. Also, to prevent the leg portion 5 from excessively rotating rearward to sufficiently stabilize the raised attitude of the leg portion 5 and the chair 3, a stopper, e.g. a bolt 8 is, as shown in FIGS. 5(*a*) and 5(*b*), attached to the base frame 4 so as to protrude toward the leg portion, and a lock member, e.g. a horizontal rod 9 is fixed or secured to the leg portion 5, thereby enabling the horizontal rod 9 to abut against a front surface of the bolt 8, with the leg portion 5 taking the right raised attitude.

Further, a corner portion of a crank member 10 is rotatably supported, through a shaft 11, on a rear portion of the base frame 4 with respect to a hinge-connection position of the leg portion 5. Preferably, the shaft 11 is penetrated through all the crank members on the same deck as a common shaft. Moreover, this common shaft may not be a single shaft continuous over the whole length, and may consist of a plurality of shaft members connected to one another.

Then, each of the crank members 10 is provided with a swing arm 12 protruding from the base frame 4, and a hook 13 protruding from a lower end portion of the swing arm 12 forward, i.e. on a side of the leg portion, thereby enabling the hook 13 to be engaged with the horizontal rod 9 of the leg 5 which is in the raised attitude. On this occasion, the swing arm 12 has an upward protruding length as that its distal end portion abuts, as apparent from FIG. 4, against a front end surface 2*a* of the upper stage-side deck 2 when the hook 3 is engaged with the horizontal rood 9. More preferably, the distal end portion is rotatably attached with a roller 14, thereby decreasing a friction force between the swing arm 12 and the upper stage-side deck 2.

Also preferably, connected to such a crank member 10 is one end of auxiliary spring means, e.g. an extension coil spring 15 for urging the swing arm 12 rearward, and the other end of the coil spring 15 is connected to the base frame 4. On the other hand, a rearward swing limit position of the swing arm 12 is specified by a notch end face 4*b*, as a positioning means, which is formed on a top wall 4*a* of the base frame 4, as shown in a perspective view of FIG. 5.

Figure 6A:
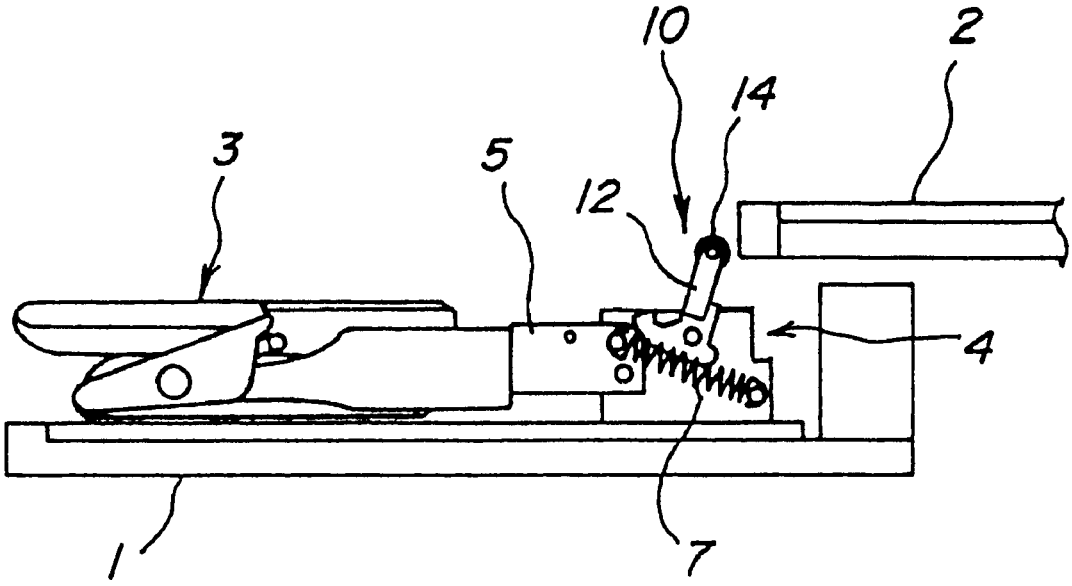
FIGS. 6 are side views showing modes in which a chair is raised.
Figure 6B:
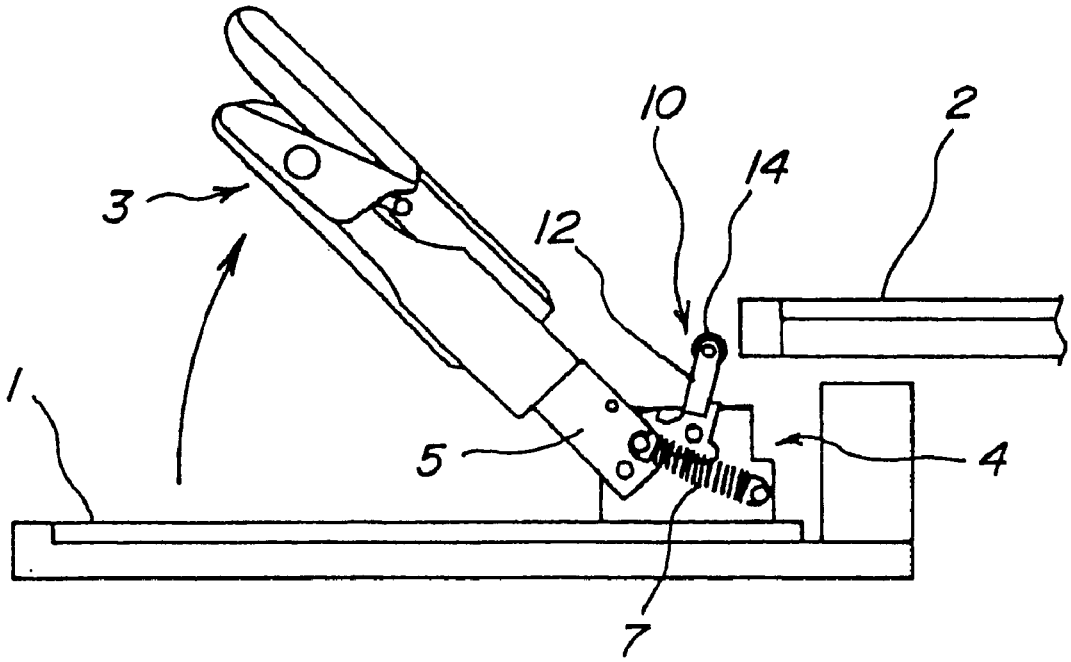

In thus constructed raising and folding apparatus, when the specified deck is protracted, the chair 3 on the deck 1 is in the folded state as exemplified in FIG. 6(*a*), the crank member 10 is in the rearward swing limit position at which the swing arm 12 abuts against the notch end surface 4*b* due to the action of the extension coil spring 15. Accordingly, the above-mentioned chair 3 is raised by rotating the chair 3 on the required deck in the raised direction by means of the manual work of the worker as exemplified in FIG. 6(*b*) to thereby engage the horizontal rod 9 of the chair leg portion 5 with the hook 13 of the crank member 10 positioned at the rearward swing limit position.

Figure 7:
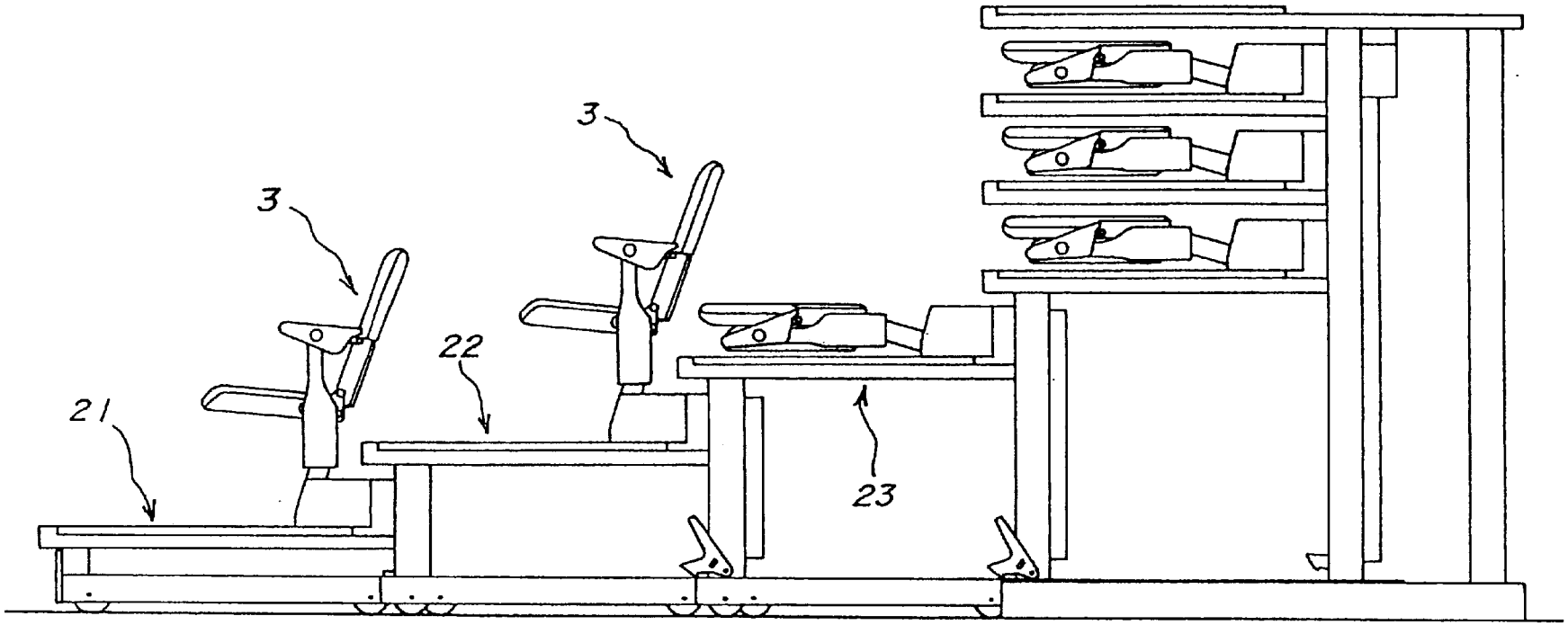
FIG. 7 is a side view showing a state in which lower stages of decks are protracted.
Figure 8C:
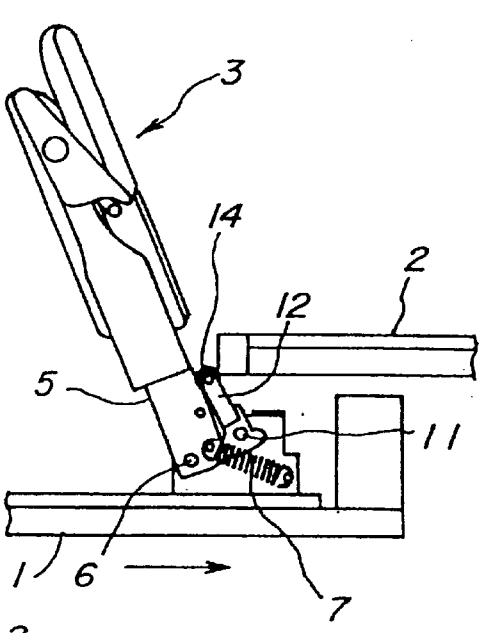
FIGS. 8 are side views showing modes in which the chair is folded.
Figure 8B:
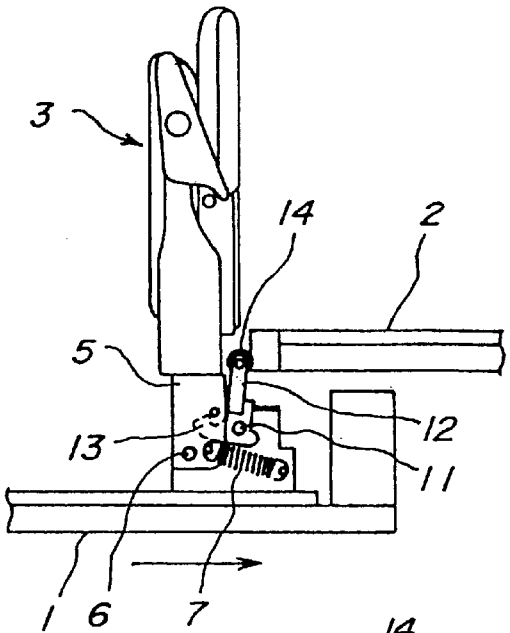
Figure 8A:
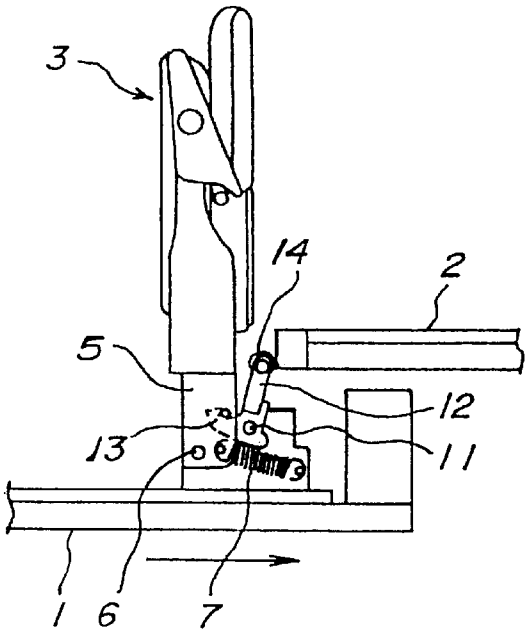
Figure 8D:
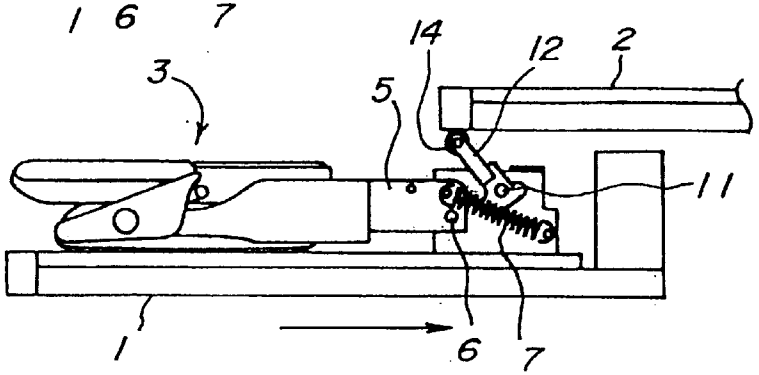

To this end, when protracting intermediate stages of the decks out of a plurality of stages of the decks, e.g. the lowest two stages of the decks 21, 22 out of six stages of the decks in the example in FIG. 7 to thereby cause the spectators, etc. to sit thereon, all the chairs 3 can be maintained in the folded state for the third stage of the deck 23, which is obliged to be protracted only for spectators to properly sit on the chairs 3 on the second stage of the deck 22. This sufficiently prevents the spectators, etc. from entering into the third stage of the deck 3 and sitting on the chair 3 of the deck without disposing means for restricting entering into the third stage deck 23, stationing guides, etc.

On the other hand, after the use of the moving stand has been finished, the respective decks are retracted in the ascending order from the lowest stage-side with the chairs 3 maintained in the raised state, thereby causing the decks to be accommodated with the respective chairs 3 automatically folded forward.

On this occasion, the chairs 3 are, according to the decks' retracting-displacement, automatically folded as follows:

First, as shown in FIG. 8(*a*), the swing arm 12 of the crank member 10, in its turn the roller 14 disposed thereon abuts against the front end surface 2*a* of the upper stage-side deck 2, thereby causing the swing arm 12, in its turns the hook 13 to swing, as shown in FIG. 8(*b*) around the rotatably supporting shaft, preferably together with shaft 11, which causes the horizontal rod 9 of the leg portion to be separated from the hook 13. This allows the leg portion 5 of the chair 3 to rotate around the pin 6 in the folded direction; thereafter, the upper stage-side deck 2 causes the swing arm 12 to further swing when the deck 1 is continuously retracted, which causes the leg portion 5 to be, as shown in FIG. 8(*c*), rotated or folded against the spring force of the coil spring 7 through the roller 14.

Then, such a rotation or folding of the leg portion 5 causes the chair 3 including the leg portion 5 to move in position of the center of gravity in the folded direction. When the chair 3 is folded against the spring force of the coil spring 7 without the action of the external force, it is folded, while undergoing the cushion action of the coil spring 7, at a speed higher than the swing speed of the swing arm 12, thereby resulting in the perfectly folded state in which the back surface of the seat plate is supported by the deck 1, as shown in FIG. 8(*d*).

As a result, the subsequent retracting-displacement of the deck 1 is carried out for only the purpose of accommodating the deck 1.

Then, although the chair 3 is thus folded, in a case where the rotatably supporting shaft 11 is arranged commonly to all the crank members on the same deck, and also fixed or secured to all the crank members, the leg portion of the chair being unlocked in any one of the crank members causes all the crank members to be simultaneously unlocked. Therefore, as shown in, e.g. the schematic plan view of FIG. 9, even if the specified deck 21 is retracted with its attitude inclined in the longitudinal direction when the decks are accommodated, the swinging-displacement of the crank member 10 which is first disengaged with the horizontal rod 9 of the leg portion 5, the right end one in the drawings, causes all the other crank members 10 to be unlocked.

Figure 9:
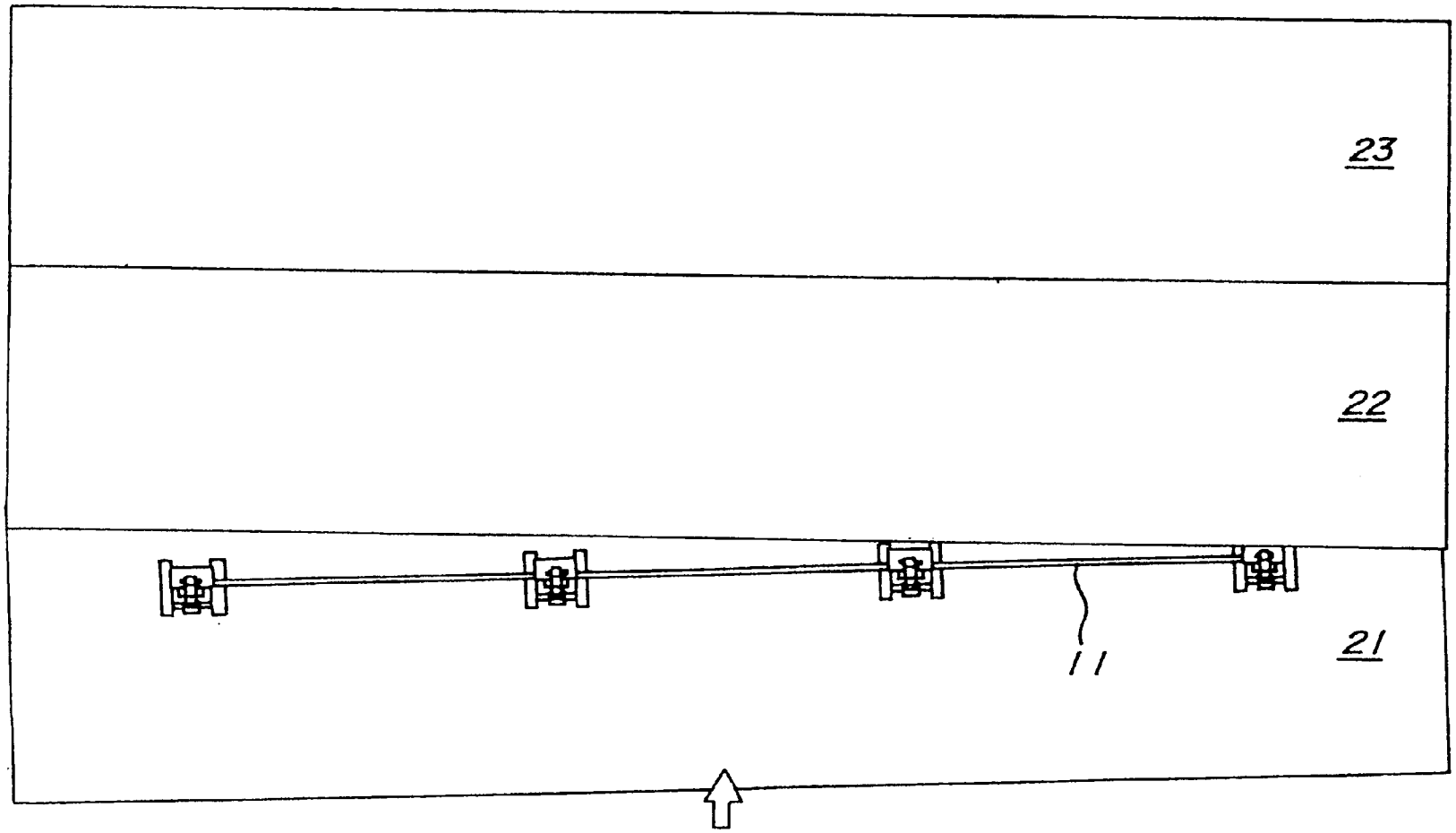
FIG. 9 is a schematic plan view showing a state in which a deck is retracted in an inclined condition.

Therefore, even if a plurality of the chairs disposed on the same deck are connected to one another, and the deck takes the rearward retracted attitude shown in FIG. 9 when they are accommodated, no connected chairs undergo a torsional external force and other external forces, thereby resulting in a permanently smooth and sure folding operation.

Figure 10A:
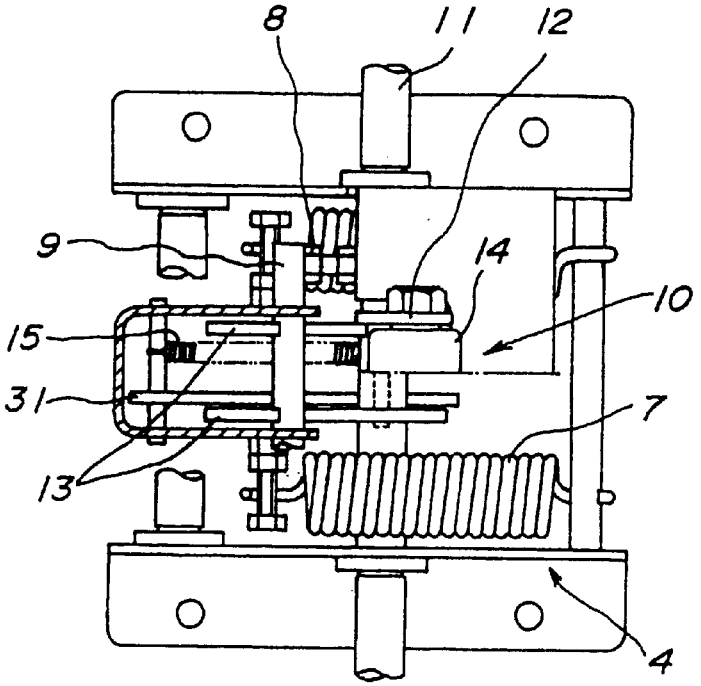
FIGS. 10 are views showing another embodiment of the present invention.
Figure 10B:
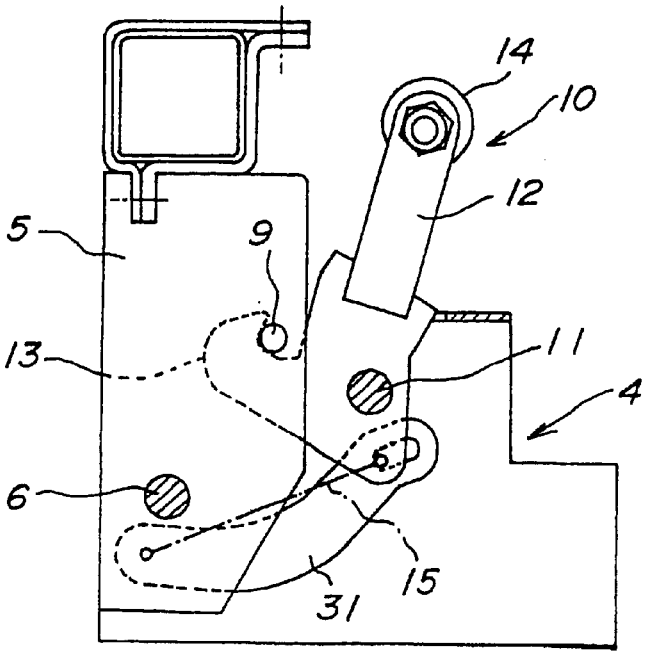

FIG. 10 is a view showing another embodiment of the present invention. This embodiment is different from that of FIG. 5 in that a portion of the raised leg portion 5 below the hinge pin 6 is connected through a pressing link member 31 to a portion of the corner portion of the crank portion 10 opposite to the hook 13 with respect to the rotatably supporting shaft 11.

The pressing link member 31 shown in the drawings is shaped like a slightly curve protruding downward in order to prevent interference with the pin 6 and the shaft 11, and also has, e.g. an oblong hole, at a portion thereof connected to the crank member 10, for allowing the crank member 10 to slightly swing around the shaft 11 in order to ensure the hook 13 engaging to and disengaging from the horizontal rod 9.

In this embodiment, the extension coil spring 15 as auxiliary spring means for urging the swing arm 12 rearward is bridged between respective connecting pings of the pressing link member 31, thereby decreasing a required extending amount of the extension coil spring 15 compared with that of the above-mentioned embodiment.

Figure 11A:
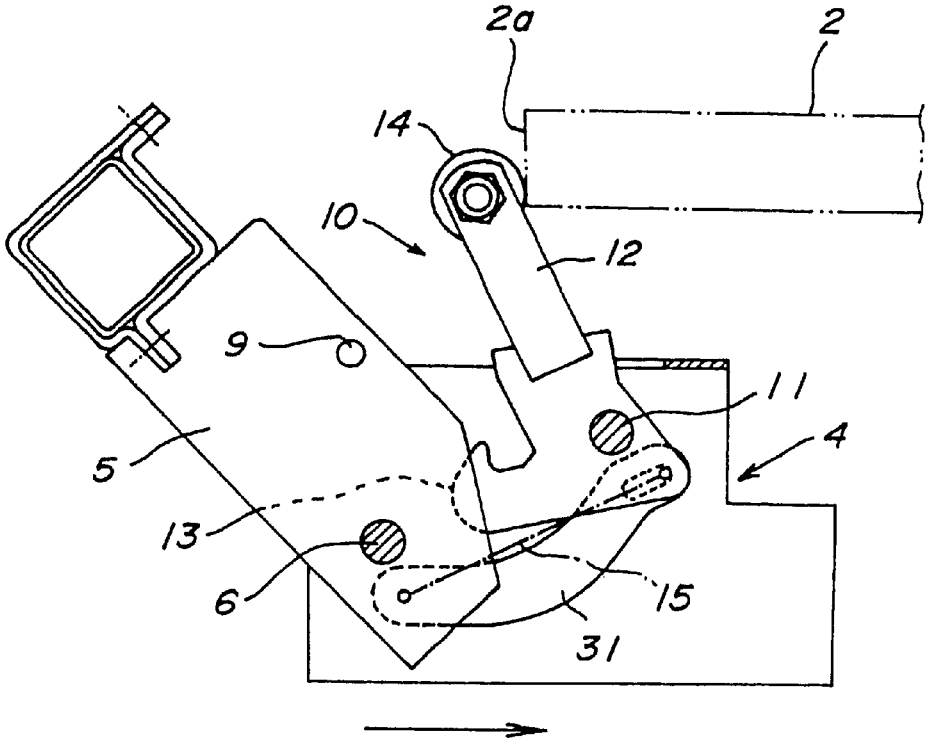
FIGS. 11 are views useful in explaining an operation of the construction shown in FIGS. 10.
Figure 11B:
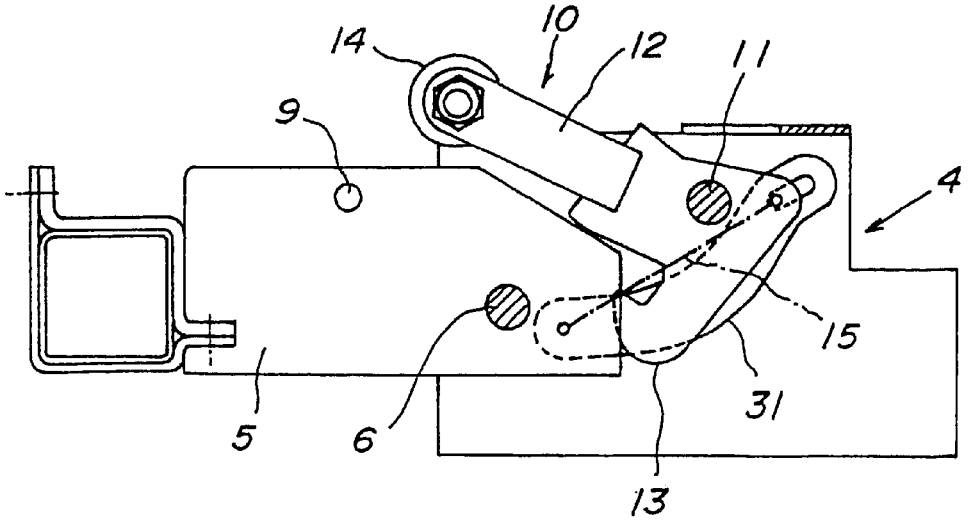

According to thus constructed raising and folding construction, e.g. when retraction of the lower stage-side deck causes the distal end of the swing arm 12 to abut, as shown by the imaginary line in FIG. 11(*a*), against the front end surface 2*a* of the upper stage-side deck 2, the swing arm 12 is rotated within a range of the length of the oblong hold disposed on the link member 31, thereby causing the hook 13, for holding the leg portion 5 in the raised state as shown in FIG. 10(*b*), to be separated from the horizontal rod 9. Therefore, when the lower stage-side deck is further retraced, the swing arm 12 presses the leg portion 5, thereby causing the leg portion 5 to be folded as is the case with FIG. 8, which causes the leg portion 5 to be, as shown in FIG. 11(*b*), perfectly folded on the lower stage-side deck.

Then, according to this raising and folding construction, when the leg portion 5 is thus folded, the pressing link member 31 presses a portion thereof connected to the crank member 10 against the spring force of the tension spring force 15, thereby causing the swing arm 12 also to be, as the leg portion 5 is folded, gradually folded in the same direction, which causes the swing arm 12 to be, when the led portion 5 takes the folded attitude, maintained in the folded state as shown in FIG. 11(*b*).

Figure 12A:
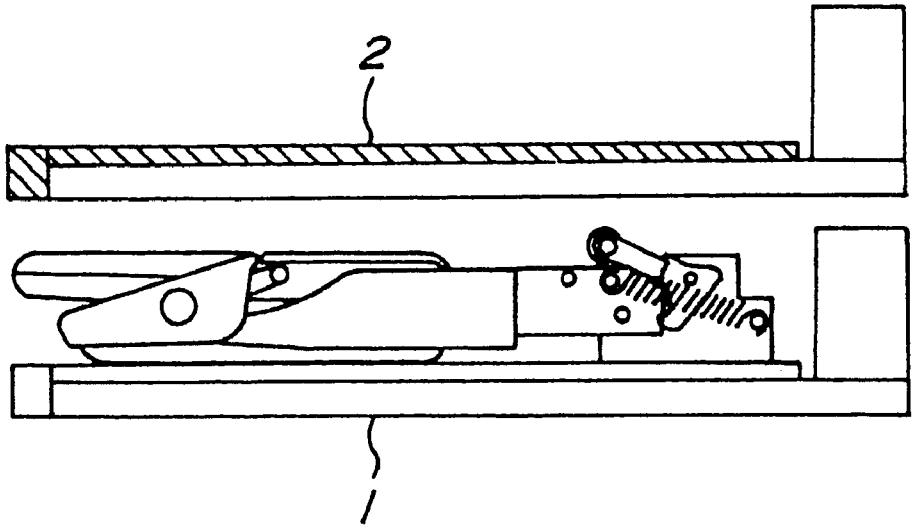
FIGS. 12 are views useful in explaining, in contradistinction to each other, states in which a swinging arm is changed in attitude.
Figure 12B:
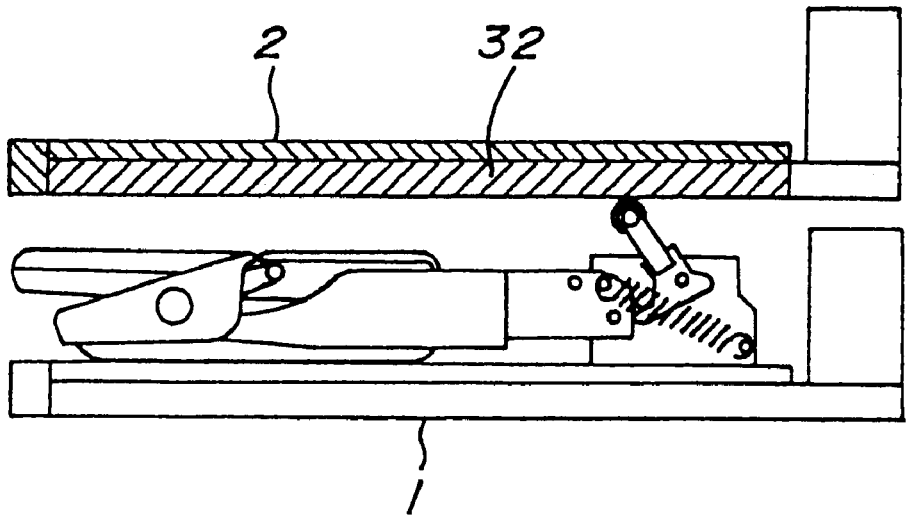

Therefore, when the lower stage-side deck is entered into just below the upper stage-side deck with the leg portion 5, in its turn the chair 3 perfectly folded, the distal end of the swing arm 12 is positioned, as shown in FIG. 12(*a*), so as to be sufficiently separated from the back surface of the upper stage-side deck 2; therefore, protracting the lower stage-side deck 1 toward the upper stage-side deck 2 may not cause the distal end of the swing arm 12 to abut against the back surface of the upper stage-side deck 2.

On the other hand, according to the above-mentioned raising and folding construction shown in FIG. 4, etc., the swing arm 12 takes, also when the leg portion 5 and the chair 3 are perfectly folded, the raising attitude shown in FIGS. 6(*a*), 8(*d*), etc., or the rearward inclined attitude. In such a case, as shown in FIG. 12(*b*), attaching arm guide means, e.g. a guide rod 32, positioned corresponding to the swing arm 12, to the back surface of the upper stage-side deck 2 so as to extent in the longitudinal direction of the deck substantially eliminates the unevenness of the back surface of the deck, and hence, when the lower stage-side deck is entered into below the upper stage-side deck together with the chairs, etc. and protracted from below the upper stage-side deck, the guide rod 32 guides the movement of the distal end of the swing arm, which requires preventing the swing arm from unexpectedly abutting against the back surface of the deck.

Therefore, the construction shown in FIG. 10 eliminates, compared with the above case, the need for the design man-hours of determining the attaching position of the guide rod 32 and the man-hours of attaching the guide rod 32, and hence effectively reduces the weight of the deck, the cost, etc.

Then, in the construction shown in FIG. 10, the leg portion 5 is raised by a worker applying an upward external force to the leg portion 5 taking the attitude shown in FIG. 11(*b*) to thereby rotate it, functioning the link member 31 as an tension member in this case to thereby displace the swing arm 12 together with the leg portion 5 in the raising direction, finally engaging the horizontal rod 9 to the hook 13 with leg portion 5 taking the perfect raised attitude shown in FIG. 10(*b*).

Figure 13A:
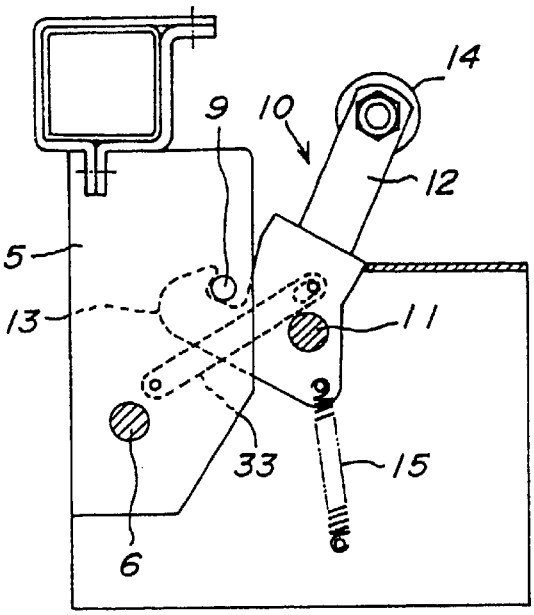
FIGS. 13 are sectional side views of a main part of another embodiment of the present invention.
Figure 13B:
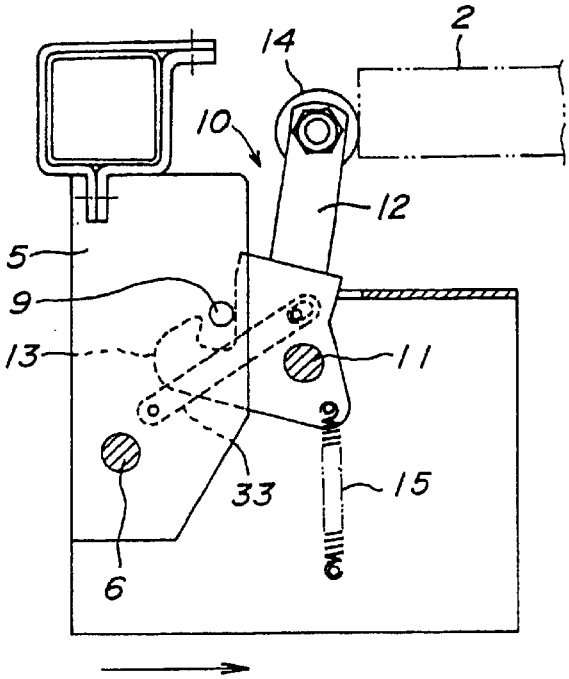
Figure 13C:
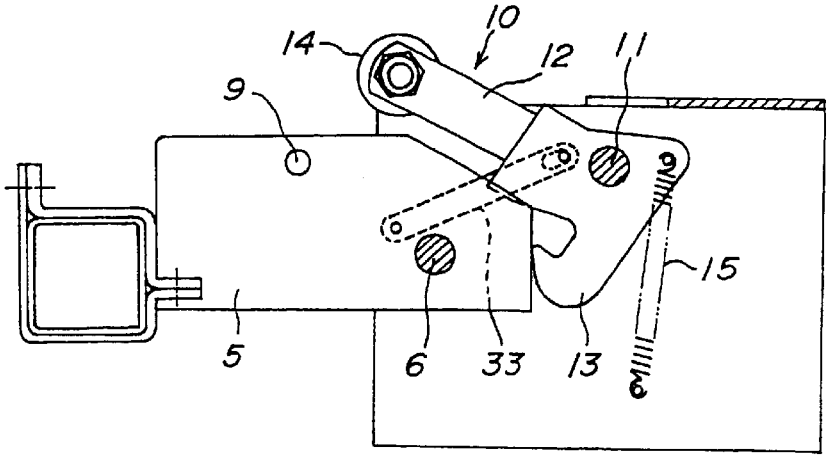

FIG. 13 is a sectional side view of a main part of another embodiment. The link member is comprised of an tension link member 33, one end of which is connected to a portion of the leg portion 5, which is slightly above the pin 6 when the leg portion 5 takes the raised attitude, and the other end is connected to a portion of the crank member 10, which is on a side of the swing arm with respect to the rotatably supporting shaft 11. Then, the extension coil spring 15 is connected to the corner portion of the crank member 10 and the best frame 4, respectively.

According to thus constructed raising and folding construction, the leg portion 5, which is in the perfect raised state as shown in FIG. 13(*a*), is folded by causing the distal end of the swing arm 12 to abut against the upper stage-side deck 2 as shown in FIG. 13(*b*), to thereby rotate the swing arm 12, preferably together with the rotatably supporting shaft 11, thereby causing the hook 13 to be separated from the horizontal rod 9, and continuously pressing the leg portion 5 through the swing arm 12. Such folding-displacement of the leg portion 5 causes the tension link member 33 to undergo a tension force, thereby causing the swing arm 12 to be folded in the same direction, which causes the swing arm 12 also to be maintained in the folded attitude when the leg portion 5 takes the perfect folded attitude as shown in FIG. 13(*c*).

Therefore, using this construction also sufficiently eliminates a fear that the distal end of the swing arm 12 abuts against the unevenness of the back surface of the upper stage-side deck 2, etc. without requiring applying special arm guide means to the back surface.

Also, according to this construction, the leg portion 5 is raised by rotating the swing arm 12 also in the raising direction using the pressing function of the link member 33 exhibited when the leg portion 5 is rotated in the raised direction, and finally engaging the horizontal rod 9 to the hook 13 as shown in FIG. 13(*a*).

Figure 14A:
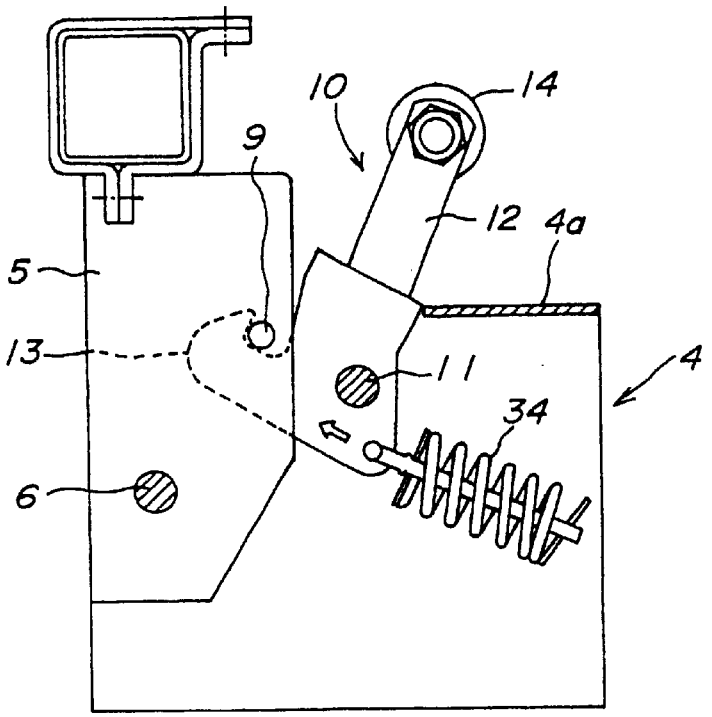
FIGS. 14 are sectional side views of a main part of still another embodiment of the present invention.
Figure 14B:
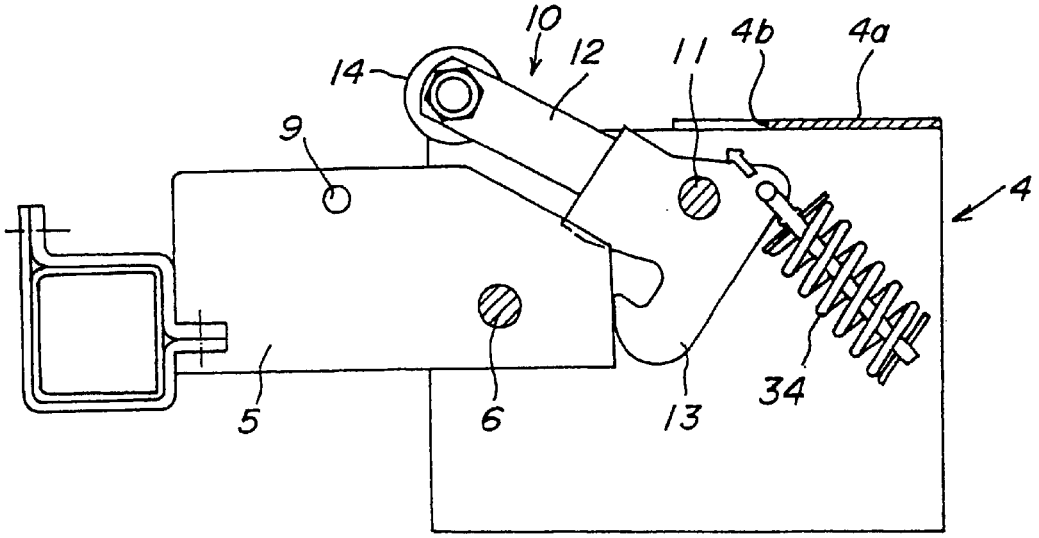

FIG. 14 is a sectional side view of a main part of still another embodiment. In FIG. 14, a compression spring 34 as one example of spring means is connected, at one end thereof, to the corner portion of the crank member 10 opposite to the hook 13 and the swing arm 12 with respect to the rotatably supporting shaft 11 of the crank member 10, and connected to the base frame 4 at the other end thereof, which makes the spring 34 a so-called over center type of functioning as a compression spring even when a center line of the spring 14 is positioned at either sides of a center of the shaft 11 according to the rotation-displacement of the crank member 10. This causes the swing arm 12 to undergo a click movement in the raising direction and the folding direction.

Moreover, this construction is provided with positioning means, e.g. the notch end surface 4*b* of the base frame top wall 4*a*, described using FIG. 5(*c*), for restricting the rearward inclination position of the swing arm 12 in order to prevent the swing arm 12 from being excessively displaced in the raised direction. On the other hand, the raised direction-wise movement of the swing arm 12 is defined by abutment of the swing arm 12 or the crank member 10 to the leg portion 5, which eliminates the need for providing special positioning means.

According to such a raising and folding construction, when the leg portion 5 takes the raised attitude, the compression spring 14 exerts the clockwise force to the crank member 10 as shown in FIG. 14(*a*), thereby strengthening the engagement between the hook 13 and the horizontal rod 9.

On this occasion, the leg portion 5 is folded as is the case with each of the above mentioned embodiments, the rotational movement of the swing arm 12 based on abutment of the swing arm 12 to the upper stage-side deck causes the hook 13 to be separated from the horizontal rod 9, and then the leg portion 5 to be folded, as shown in FIG. 14(*b*).

In this case, the compression spring 34 is displaced in a direction opposite to that of the shaft 11 while being slightly compression-deformed in itself, thereby causing the swing arm 12 to be, when the leg portion 5 takes the perfect folded attitude shown in FIG. 14(*b*), urged in the raised direction.

As a result, this raising and folding construction also is capable of sufficiently eliminating a fear that the distal end of the swing arm 12 abuts against the back surface of the upper stage-side deck, etc. without providing special arm guide means on the back surface of the upper stage-side deck.

Figure 15A:
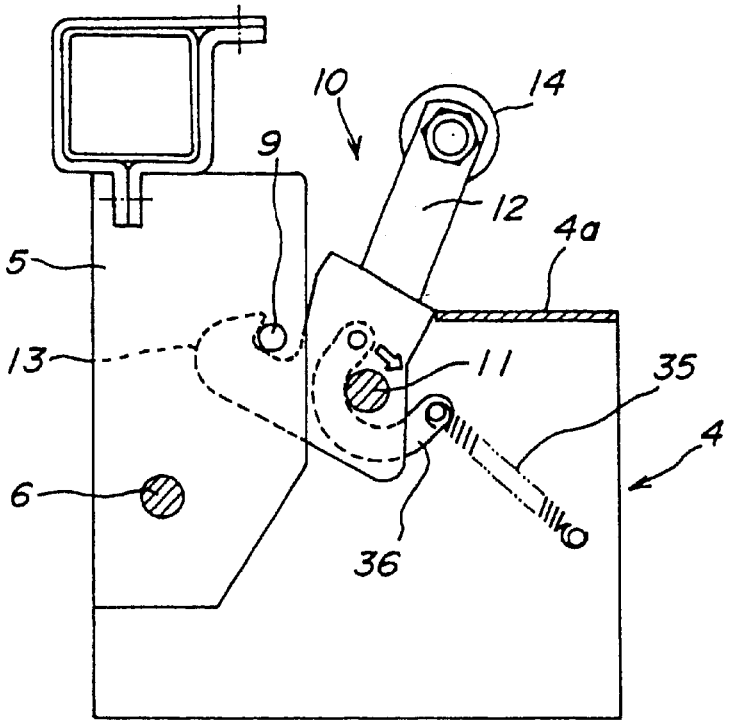
FIGS. 15 are sectional side views of a main part of further another embodiment of the present invention.
Figure 15B:
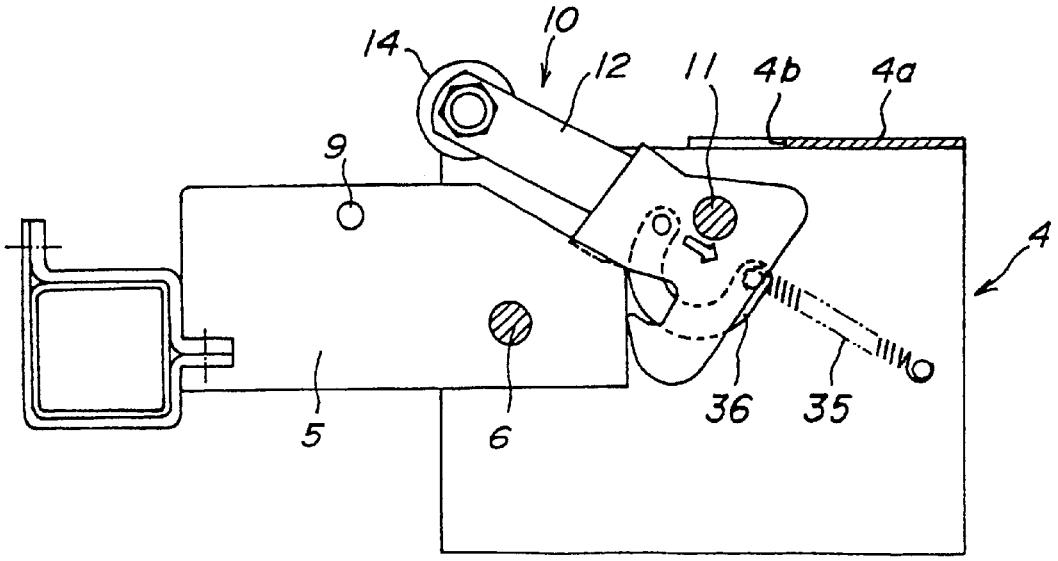

FIG. 15 shows a case in which an extension spring 35 is used as the spring means. In this case, the point of application of force of the extension spring 35 is arranged on the crank member 10 at a side of the hook 13 and the swing arm 12 with respect to the rotatably supporting shaft 11 of the crank member 10, and also an escape piece 36 is interposed between the extension spring 35 and the point of application of force in order to prevent interference between the rotatably supporting shaft 11 and the extension spring 35.

The above-mentioned spring 35 also functions as the so-called over center type spring as is the case with the above-mentioned compression spring 34, thereby causing the swing arm 12 to undergo a click movement. Also, selection of the point of application of force increases the engagement force between the hook and the horizontal rod 9 when the leg portion 5 takes the raised attitude as shown in FIG. 15(*a*), and maintains the swing arm 12 in the folded state when leg portion 5 takes the folded attitude as shown in FIG. 15(*b*).

As a result, this construction provides the same operation and effect as FIG. 14.

INDUSTRIAL APPLICABILITY

As apparent from the descriptions above, the present invention provides a chair-raising and folding construction for a moving stand which is simple in construction, and reduced in weight and occupied space, and which is capable of, when using the moving stand with lower stages of decks protracted, effectively preventing spectators, etc. from entering into non-used decks protracted.

In particular, it is possible, when the chairs on the decks are connected to one another, to smoothly and surely fold the chairs irrespective of the retracted attitude of the deck, thereby sufficiently preventing the chairs from receiving an unexpected force such as a torsional force, etc.

What is claimed is:

1. A chair-raising and folding construction for a moving stand, which is capable of substantially and telescopically accommodating and protracting a plurality of horizontal decks arranged at spaces in a vertical direction, each of said decks having a plurality of raised and foldable chairs, said construction comprising:

a leg portion of said chair that is hingedly connected in a foldably forward direction to a base frame disposed on said deck; and a crank member comprising a swing arm protruding upwardly from said base frame and a hook protruding forwardly from a lower end portion of said swing arm, a corner portion of said crank member being rotatably supported on a rear portion of said base frame, said swing arm has such a protruding length so that a distal end portion thereof abuts against a front end surface of the upper stage-side deck, and said leg portion is provided with a lock member engaged with said hook when said leg portion is raised upwardly in the vertical direction.

2. A chair-raising and folding construction for a moving stand, as claimed in claim 1, wherein shafts for rotatably supporting said crank members to said base frames are constructed as a common shaft of all said crank members arranged on the same deck.

3. A chair-raising and folding construction for a moving stand, as claimed in claim 1, further comprising leg portion spring means for urging said leg portion in the raising direction, and a stopper for preventing said leg portion from being inclined rearward.

4. A chair-raising and folding construction for a moving stand, as claimed in claim 1, further comprising auxiliary spring means for urging said swing arm rearward, and positioning means for restricting the rearward inclined position of said swing arm.

5. A chair-raising and folding construction for a moving stand, as claimed in claim 1, wherein said leg portion and said crank member are connected to each other by a link member forcing said swing arm to be folded forward with folded movement of said leg portion, and said construction comprises auxiliary spring means for urging said swing arm rearward.

6. A chair-raising and folding construction for a moving stand, as claimed in claim 5, wherein said link member comprises one of a pressing link member and a tensile link member.

7. A chair-raising and folding construction for a moving stand, as claimed in claim 1, comprising spring means for urging said swing arm in a forward and a rearward direction with the folding-displacement and the raising-displacement of said leg portion, respectively, and positioning means for restricting the rearward inclined position of said swing arm.

8. A chair-raising and folding construction for a moving stand, as claimed in claim 7, wherein said spring means comprises one of a pressing spring and a tensile spring.

* * * * *